US005660045A

United States Patent [19]

Ito et al.

[11] Patent Number: 5,660,045

[45] Date of Patent: Aug. 26, 1997

[54] GAS TURBINE COMBUSTOR AND GAS TURBINE

[75] Inventors: Kazuyuki Ito, Hitachinaka; Tadayoshi Murakami, Hitachi; Nariyoshi Kobayashi, Hitachinaka; Shigeru Azuhata; Yoshikazu Moritomo, both of Hitachi, all of Japan

[73] Assignee: Hitachi, Ltd., Tokyo, Japan

[21] Appl. No.: 502,461

[22] Filed: Jul. 14, 1995

[30] Foreign Application Priority Data

Jul. 20, 1994 [JP] Japan ..... 6-167697

[51] Int. Cl.[6] ..... F02C 1/00

[52] U.S. Cl. ..... 60/737; 60/739; 60/747; 60/748; 60/749

[58] Field of Search ..... 60/737, 739, 742, 60/747, 748, 749, 760

[56] References Cited

U.S. PATENT DOCUMENTS

| | | | |
|---|---|---|---|
| 3,713,588 | 1/1973 | Sharpe | 60/748 |
| 3,736,746 | 6/1973 | DuBell et al. . | |
| 4,445,339 | 5/1984 | Davis, Jr. et al. . | |
| 4,463,568 | 8/1984 | Willis et al. . | |
| 4,850,194 | 7/1989 | Fuglistaller et al. | 60/748 |
| 5,216,885 | 6/1993 | Taniguchi et al. . | |
| 5,319,936 | 6/1994 | Ikeda et al. | 60/737 |
| 5,328,355 | 7/1994 | Kobayashi et al. | 60/747 |
| 5,365,738 | 11/1994 | Etheridge | 60/748 |
| 5,487,274 | 1/1996 | Gulati et al. | 60/737 |

FOREIGN PATENT DOCUMENTS

| | | |
|---|---|---|
| 57-115624 | 7/1982 | Japan . |
| 59-101551 | 6/1984 | Japan . |
| 1-137117 | 5/1989 | Japan . |
| 1-210721 | 8/1989 | Japan . |

*Primary Examiner*—Charles G. Freay

*Attorney, Agent, or Firm*—Fay, Sharpe, Beall, Fagan, Minnich & McKee

[57] ABSTRACT

The present invention has an object to provide a gas turbine combustor which is able to effect stable combustion in a wide range of fuel flow rate. A burner 1 is provided with fuel nozzles 31 and 32. When a fuel flow rate is small, diffusion flame is formed with fuel supplied from the nozzle 31 with a ring-shaped flame stabilizer 11. Next, fuel is supplied from the nozzle 32 to mix with air, reach to the flame stabilizer 11 and be held by the diffusion flame already formed, whereby stable premixed flames are formed in the flame stabilizer 11 from a range of low fuel air ratio. Further, when flame is propagated from the burner 1 to the burner 2, a fuel air ratio at the outer periphery side of the burner 1 is locally raised by the fuel supplied from the nozzle 31, whereby the combustion stability can be raised in a wide range of fuel flow rate and propagation of flame to adjacent burners becomes easy.

15 Claims, 7 Drawing Sheets

GAS TURBINE COMBUSTOR AND GAS TURBINE

BACKGROUND OF THE INVENTION

The present invention relates to a gas turbine combustor and a gas turbine and, more particularly to a gas turbine combustor which is able to effect both of premixed combustion and diffusion combustion.

Conventional burners of various constructions are proposed for use in gas turbine combustors. An example of those burners is disclosed in JP A 1-137117 in which a diffusion pilot section of a fuel feed pipe and an air feed pipe arranged coaxially is provided in the center of a premixing chamber. U.S. Pat. No. 4,463,568 discloses a proposal in which various kinds of fuel are available, a baffle plate is arranged at an outlet of a supply pipe for mixture gas of fuel and gas, and an air supply pipe is arranged in an outer periphery thereof for a gas flow to spread toward the outer peripheral portion. JP A 59-101551 discloses a proposal in which a premixing chamber of fuel and air and an air supply pipe for a diffusion pilot burner are common, only air is flowed into the premixing chamber according to load. Further, an example of conventional stabilizers is disclosed in JP A 57-115624 in which a small wing is mounted on a V-shaped stabilizer (V gutter) to make better mixing in accompanying flows in the wake of the V gutter. Further, JP A 1-210721 proposes a method of mounting of a stabilizer having a generally V-shaped cross-section. Still further, U.S. Pat. No. 3,736,746 discloses a proposal concerning an arrangement position of a stabilizer.

For gas turbines, it is necessary to be operated under a wide output range corresponding to a large load change from start up to a rated load. Therefore, one of essential factors for the gas turbines is stable combustion and no occurrence of misfire even if operational conditions such as air flow rate, fuel flow rate, etc. change largely from the starting to the rated load.

On the other hand, a combustion method in which NOx production is suppressed is desired strongly for gas turbine combustors in order to reduce emission of NOx from the gas turbine combustors. Premixed combustion that fuel and air are premixed and then subjected to combustion can realize low NOx emission, so that use of the premixed combustion increases in order to comply with a demand of low NOx emission which is increasing more and more recently. However, in general, the premixed combustion is narrow stable combustion range and easy to fall into misfire as compared with diffusion combustion in which fuel and air are burnt while they are being mixed. Therefore, in order to reduce NOx emission while keeping combustion stable, it is necessary to combine effectively the diffusion combustion and the premixed combustion.

For gas turbine combustors, a fuel air ratio (fuel flow rate (kg/sec)/air flow rate (kg/sec)) which is weight ratio between fuel flow rate supplied into the combustor and air flow rate from a compressor is a important factor of combustion stability. Of misfire, there are two cases, in one case of which flame is blown out when fuel air ratio is small or air flow velocity is fast, and in another case, fuel air ratio is large and flame is blown out by floating up of the flame or combustion vibrations.

In gas turbine combustors, a fuel air ratio of the entire combustor changes from about 0 at time of starting to about 0.028 at the rated load including air for cooling which also flows into the combustor. However, the air for cooling flowing into the combustor is small around the burner and only air may be supplied from a burner not served burning under some operational conditions, so that it should be considered that a partial fuel air ratio of the burner serving the combustion becomes 0.05 or more in maximum.

The above-mentioned any conventional technique does not take sufficiently into consideration forming clearly flame stabilization region or zone in such a wide range of fuel air ratio, particularly, flame stabilization when fuel flow rate is small at such time as start up time, speed increasing time or low load operation time. Further the technique does not touch flame stabilization while reducing NOx emission under operational conditions that fuel flow rate is large.

SUMMARY OF THE INVENTION

An object of the present invention to provide a gas turbine combustor which is able to effect both of diffusion combustion and premixed combustion, stably burn under operational conditions of a wide range of air flow rate and fuel flow rate, and is unlikely to fall into misfire and able to contribute to lower NOx emission A most reliable method of effecting stable combustion by a gas turbine combustor is to form clearly a region in which combustion starts up, that is, a flame stabilization region within the combustor. The present invention uses a ring-shaped flame stabilizer as a means for forming the flame stabilization region, and provides a concrete construction of a gas turbine combustor provided with the ring-shaped stabilizer.

The gas turbine combustor according to the present invention is characterized by comprising a combustion chamber, a premixing chamber for forming premixed gas by mixing in advance fuel and combustion air introduced into the combustion chamber, a ring-shaped flame stabilizer placed at an outlet end of the premixing chamber, having a divergent shape spreading toward a downstream side, deflecting premixed gas from a straight flow to annular flow and generating vortexes or recirculation zone during the deflection of the premixed gas, and a fuel inlet hole provided on a wall adjacent to the outlet of the premixing chamber for injecting fuel to the inside of the premixing chamber.

With the gas turbine combustor, premixed combustion is effected by premixed gas of fuel and combustion air introduced into the premixing chamber, and diffusion combustion is effected by fuel injected from the wall adjacent to the outlet of the premixing chamber into the interior of the premixing chamber and combustion air flowing in the premixing chamber. The combustion air is used commonly for premixed combustion and diffusion combustion. Further, the premixed combustion and the diffusion combustion are switched over according to gas turbine load. This switching can be carried out by providing a flow regulation valve on each of a supply passage of fuel for premixed combustion and a supply passage of fuel for diffusion combustion, and adjusting the flow regulation valves according to the gas turbine load.

A plurality of gas turbine combustors, for example, 14 gas turbine combustors are arranged on an outer periphery of the gas turbine. Air, pressurized by an air compressor connected to a rotating shaft of the gas turbine is introduced into the premixing chamber of the combustor. The air is introduced into the combustion chamber on a downstream side, flows from the downstream side toward an upstream side of the combustor, and is introduced into the premixing chamber after cooling the combustor wall in course of the flow.

Further, a gas turbine combustor according to the present invention is characterized by comprising a combustion chamber, at least one premixing chamber for forming premixed gas by premixing fuel and combustion air introduced into the combustion chamber, fuel nozzles for introducing fuel into the premixing chamber, combustion air supply means for supplying air pressurized by a compressor connected to the turbine into the premixing chamber after cooling the combustor wall by causing the combustion air to flow in the combustor from the downstream side to the upstream side, fuel inlet holes provided on a wall adjacent to an outlet of the premixing chamber, fuel supply means for supplying fuel for diffusion combustion from the outside of the combustor into the fuel inlet holes, a flame stabilizer, disposed adjacent to the outlet of the premixing chamber on a downstream side of the diffusion combustion fuel injection port, having a ring-like shape whose cross section spreads divergently downward, and fuel flow control means for controlling fuel flow rate supplied to the fuel nozzles for premixed combustion and the fuel supply means for diffusion combustion according to gas turbine load.

In the present invention, at time of a small fuel flow rate, such as start up time of the gas turbine, speed increasing time or low load operation time, fuel is supplied in a flow passage outside the ring-shaped stabilizer to make the concentration of fuel locally rich, whereby stable diffusion combustion is effected and misfire is prevented. Under the operational conditions in which fuel flow rate is large, fuel is supplied from a upstream side of the ring-shaped stabilizer to mix with combustion air, and they are flowed as premixed gas in a flame stabilization region formed on downstream side of the stabilizer. In this case, fuel flow rate and air flow rate are set so that they do not meet a misfire condition determined by fuel flow rate supplied into the flow passage outside the stabilizer, the fuel concentration in the premixed gas, nozzle injection flow velocity, etc., so that premixed combustion can be effected while securing stability of the combustion.

Here, it is desirable that a swirler is provided in an air flow passage on outer periphery side of the ring-shaped stabilizer. Since mixing of fuel and air for diffusion flame are promoted by this swirler, exhaust of carbon monoxide (CO) and unburnt substances can be reduced.

In case the swirler is provided, it is preferable to make the ring-shaped stabilizer into a cylindrical shape in which thickness thereof is uniform on the upstream side and divergently thicker toward the downstream side, and provide it with the swirler on the outer periphery of the cylindrical-shape portion and on the upstream side of the fuel inlet holes for diffusion combustion.

Further, it is preferable to provide the ring-shaped flame stabilizer with jet holes for passing fluid through the stabilizer toward the downstream side on the outer periphery side than an apex part (mount part) of the divergently spreading portion, at which the thickness starts to increase. In this case, since fuel or premixed gas which is disturbed strongly in the flow passage on the outer periphery side of the stabilizer passes through the jet holes, thereby being rectified, stable flame is formed from outlets of the jet holes.

For improvement of stability of flame formed on the inner periphery side of the ring-shaped stabilizer, a choking means is provided on the flow passage on the inner peripheral side of the ring-shaped stabilizer for choking a part of the flow passage. Concretely, a bar-like member, which extends from a bottom to a portion passing through a hollow portion of the ring-shaped stabilizer and is sharpened at its tip, is provided around the center of the premixing chamber.

Further, it is preferable to provide a plurality of projections or ribs for disturbing fluid flow on an inner periphery side wall of the thickness divergently increasing part of the ring-shaped stabilizer, or to provide a plurality of projections or ribs on a part of the bar-like member, preferably, on a portion of the member opposite to the thickness increasing part of the ring-shaped stabilizer.

Further, it is preferable to provide the bar-like member with an air flow passage for passing air therethrough and jetting the air into the inner periphery side of the ring-shaped flame stabilizer.

In a gas turbine combustor, fuel air ratio (fuel flow rate (kg/sec)/air flow rate (kg/sec)) which is weight ratio between fuel flow rate supplied into the combustor and air flow rate from a compressor is an important factor of combustion stability.

As for misfire, there are misfire that flame is blown off when fuel air ratio is small or air flow velocity is large, and misfire that flame is blown off by lifting of flame or Combustion vibrations when fuel air ratio is large.

In gas turbine combustors, a fuel air ratio of the entire combustor changes from about 0 at time of start up to about 0.028 at time of the rated load including air for cooling which also flows into the combustor. However, the air for cooling flowing into the combustor is small around the burner and only air may be supplied from the burner not served the burning under some operational conditions, so that it should be considered that a partial fuel air ratio of the burner serving the combustion becomes 0.05 or more in maximum. The present invention provides a gas turbine combustor construction which is able to form clearly flame stabilizing region in such a wide fuel air ratio range.

In the present invention, a ring-shaped flame stabilizer is provided as means for forming the flame stabilizing region. For the shape of the flame stabilizer, it is preferable to expand toward a downstream side. The ring-shaped flame stabilizer is provided at an outlet end of the fuel burner of premixed combustion, whereby substantially different flow passages are formed on the outer periphery side and on the inner periphery side of the ring-shaped flame stabilizer around end face of the stabilization region of the ring-shaped flame stabilizer. Vortexes are formed on the downstream side of the ring-shaped flame stabilizer, and combustion gas circulates.

At time of small fuel flow rate such as gas turbine start up time, speed increasing time, low load operation time, etc., fuel is supplied from the fuel inlet hole provided on the peripheral wall around the outlet of the premixing chamber constructing the premixed combustion fuel burner. The fuel is supplied in the flow passage on the outer periphery side of the ring-shaped flame stabilizer. Therefore, the degree that the fuel supplied from the fuel injection port is mixed with air flowing in the premixing chamber toward the downstream side is small, and diffusion flame is substantially formed from the outer periphery side. Further, by supplying fuel only a part of the burners, the fuel concentration becomes locally richer and stable diffusion combustion is effected.

Here, it is important that the diffusion flame is formed from the outer periphery side of the stabilizer. The reason is that in the gas turbine, in general, a plurality of burners are arranged in the combustor and flame propagation is effected between the burners according to a change of wide range in fuel flow rate, in this case, the flame propagation is easier when flame of a large fuel air ratio is formed on the outer periphery side.

Further, in the gas turbine combustor, there is a case a plurality of burners are used, only one or some specific burners are given a role of flame stabilization stabilizing stably flame and the specific burner or burners support combustion by the other burners. In this case, when the latter other burners are premixed combustion burners which burns after premixing fuel and air, low NOx emission combustion which is advantageous of the premixed combustion burner can be carried out while covering a problem of less combustion stability which is disadvantageous of the premixed burner. Formation of flame of large fuel air ratio on the outer periphery of the stabilizer holds flame of the other burners adjacent to the burner, whereby stable combustion can be achieved.

Under the operational conditions that a fuel flow rate is large, fuel is supplied from the upstream side of the flame stabilizer to mix with combustion air, and flowed, as premixed gas, into a flame stabilization region formed downstream of the flame stabilizer. Here, the position that fuel to be premixed is supplied is on an upstream side of a position at which substantially different flow passages are formed on outer periphery side and on inner periphery side of the ring-shaped flame stabilizers. Therefore, the fuel concentration of the premixed gas on the outer periphery side and on the inner periphery side is the same as each other. However, since the flow passage on the outer periphery side is already supplied with fuel and diffusion flame is formed on the flame stabilizing zone on the downstream side of the flame stabilizer, the premixed gas flowed in on the outer periphery side of the flame stabilizer is rapidly burnt to become flame of a high fuel air ratio. Therefore, the premixed gas flowed in on the inner periphery side of the flame stabilizer also starts to burn at a lower fuel air ratio due to this flame than the premixed gas is burnt independently However, it is important to set flow rates of fuel and air so as not to meet the misfire conditions determined by fuel flow rate supplied to the flow passage on the outer periphery side of the flame stabilizer, the fuel concentration of premixed gas, nozzle jet flow velocity, etc.

As mentioned above, in the present invention, fuel is supplied from two positions one of which is on the outer periphery side in the vicinity of the ring-shaped flame stabilizer positioned at the outlet end of the premixing chamber and the other is on the upstream side of the ring-shaped flame stabilizer, and the flame stabilizer stabilizes flames formed by the fuel supplied from the two positions. Further, air flowing in the premixing chamber is used as combustion air commonly for the fuel supplied from the two positions. This construction brings about the following effects.

(1) In case fuel is supplied on the outer periphery of the ring-shaped flame stabilizer, diffusion flame is formed along recirculation flow occured in the wake of the flame stabilizer. In this time, fuel air ratio is large in a combustion start region, whereby the flame is stably held. Next, this diffusion flame mixes with air passing through on the inner periphery side of the flame stabilizer around a position at which the recirculation flow terminates, whereby the fuel air ratio is lowered. This position is in the downstream of flame stabilizing zone by the recirculation flow, so that the lowering of fuel air ratio does not damage the stability of flame. On the contrary, since the lowering of fuel air ratio lowers the temperature of flame, production of NOx can be suppressed.

(2) In case fuel is supplied on the outer periphery side of the ring-shaped flame stabilizer to form stable diffusion flame and then premixed gas is supplied from an upstream side of the flame stabilizer, the premixed gas is introduced into high temperature atmosphere by the diffusion flame, so that even if the concentration is lean, exhaust of unburnt substances and carbon monoxide can be suppressed. Further, in a course that as gas turbine load increases, fuel air ratio of premixed gas is raised, when fuel supplied on the outer periphery side of the ring-shaped flame stabilizer is reduced, local high temperature zone by the diffusion combustion can be reduced continuously, so that stable and low NOx combustion is possible in a wide load range.

The above effects are due to that by having commonly the ring-shaped flame stabilizer, flame stabilizing zone is secured, and fuel supply for diffusion combustion and premixed combustion is able to be changed continuously.

In the present invention, it is desirable to provide a swirler in a flow passage on the outer periphery side of the ring-shaped flame stabilizer. Fuel supplied in the flow passage on the outer periphery side of the ring-shaped flame stabilizer has a short distance until it reaches to a combustion zone after the fuel is mixed with air flowing in the flow passage because the fuel supply position is around the end face on the flame stabilizing zone, and diffusion flame is formed substantially from the outer periphery side of the flame stabilizer. Here, when mixing of fuel and combustion air in the diffusion flame is insufficient, unburnt substances are apt to be exhausted. Provision of a swirler promotes mixing of fuel and air, and occurrence of carbon monoxide, unburnt hydrocarbons, etc. by incomplete combustion is reduced. Swirling velocity by the swirler is determined taking into consideration of fuel flow rate, pressure loss, stability of combustion, etc.

In the present invention, since fuel is supplied in the flow passage on the outer periphery side of the ring-shaped flame stabilizer, strong disturbance occurs at this portion. This becomes more remarkable by providing the swirler. Therefore, in some cases, stability of combustion is damaged by the strong disturbance, and there is the possibility that the flame is blown out. In order to prevent the blowing out of the flame, it is desirable to provide the ring-Shaped flame stabilizer with jet holes and to allow a part of fluid to pass therethrough to the downstream side thereof. The jet holes are desirable to be provided so as to pass through the ring-shaped flame stabilizer having a divergent shape at the outer periphery side than the apex of the divergent portion. Since the strong disturbance of fuel and air is rectified in course of passing through the jet holes, stable flame is formed in the flame stabilizing zone, and little influenced by disturbance of diffusion flame produced adjacent to the flame. When the diameter of the jet holes are in a range of 1 to 5 mm, an excellent effect is attained without lowering the strength of the flame stabilizer construction. The jet holes are not necessary to be parallel to the central axis of the combustor. The jet holes can be arranged at a certain angle against the central axis.

It also is desirable to provide a choking means on the flow passage on the inner periphery side of the ring-shaped flame stabilizer for choking a part of the flow passage. In case the area of the flow passage on the inner periphery side becomes large, difference in flow velocity occurs between the central portion and its surrounding portion and there is the possibility that the flame becomes unstable. This is prevented by the chocking means. Therefore, preferably, the chocking means is a solid rod or hollow rod disposed equidistantly from the inner periphery of the ring-shaped flame stabilizer. Further, it is desirable to sharpen a tip end of the rod to prevent adhesion of flame on the tip end.

It also is desirable to arrange turbulence promoters of a plurality of ribs on a wall on the inner periphery of the ring-shaped flame stabilizer and/or a wall of a choking means for choking a part of flow passage. By arranging the turbulence promoters, small vortexes of air or premixed gas are formed in the wake of the turbulence promoters and a boundary layer is broken. As a result, heat transfer coefficient increases, and heat transfer between air or premixed gas and the ring-shaped flame stabilizer adjacent to flame is promoted. Further, heat transfer increase between air or premixed gas and the flame forming zone side of the choking means for choking a part of flow passage on the inner periphery of the ring-shaped flame stabilizer. Usually, the temperature of air or premixed gas is about 100° to 400° C., on the other hand, the maximum temperature of members constructing the ring-shaped flame stabilizer or the maximum temperature of construction members of the choking means reaches 500° to 800° C. Promotion of heat transfer of them raises temperature of air or premixed gas. The higher the temperature of gas flow, the easier the combustion start up is, so that more stable combustion can be achieved. Further, promotion of heat transfer between the flame forming zone side of the above-mentioned members and gas flow also prevents occurrence of high temperature part in these members. Here, the turbulence promoters promote heat transfer by small vortexes formed in the wake of the turbulence promoters and the drift of flow. When the height of the turbulence promoters is 1 mm or more, scale of the vortex and the drift become large, and the effect of the turbulence promoters is damaged. Further, when the height of the turbulence promoters is 0.1 mm or less, there is no effect of occurrence of turbulent flow. Therefore, the height of the turbulent flow promotor is limited to a value between 0.1 mm or more and 1 mm or less, whereby heat transfer performance of the turbulence promoters can be kept to a high level.

It is desirable to provide the choking means with means for supplying air into the flow passage on the inner periphery side of the ring-shaped flame stabilizer. This is a countermeasure of that the flames formed from the inner periphery side of the ring-shaped flame stabilizer interferes with each other and the combustion becomes unstable. In this case, it is preferable to form the choking means by a hollow rod disposed equidistantly from the inner periphery of the ring-shaped flame stabilizer. Further preferably, air is jetted along the central axis of the ring-shaped flame stabilizer. By the jet air flow, it is prevented that the flames formed from the inner periphery side of the ring-shaped flame stabilizer are interfered with each other in the wake.

By incorporating the gas turbine combustor of the above-mentioned construction into a gas turbine or a gas turbine power generation equipment, the reliability of the gas turbine and the gas turbine power generation equipment can be achieved.

DESCRIPTION OF PREFERRED EMBODIMENTS

An embodiment of the present invention is explained, referring to FIGS. 1 to 12.

Figure 1:
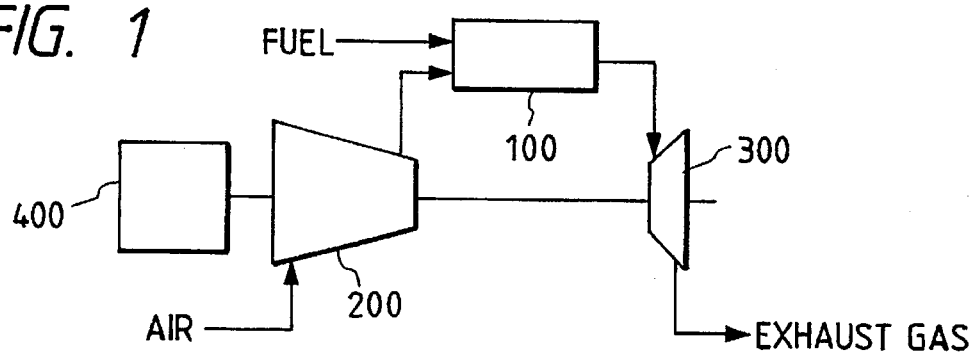
FIG. 1 is a schematic diagram of a construction of a gas turbine power generation equipment of an embodiment of the present invention.

A gas turbine of the present embodiment is constructed of, as shown in FIG. 1, an air compressor 200 for taking in air from the atmosphere and compressing the air, gas turbine combustors 100 supplied with air compressed by the compressor 200 and fuel and generating combustion gas, a gas turbine 300 driven by the combustion gas, an electric generator 400 rotated by drive force of the combustion gas to generate electric power, etc. As described later, by using the gas turbine combustor 100 of the present embodiment, a gas turbine which is of a combination of the gas turbine 300 driven by combustion gas produced within the gas turbine combustor 100, the air compressor 200 connected to a rotating shaft of the gas turbine, etc. is excellent in reliability without the possibility that misfire occurs.

Further, incorporation of it into a gas turbine power generation equipment can raise the reliability of a power plant.

Figure 2:
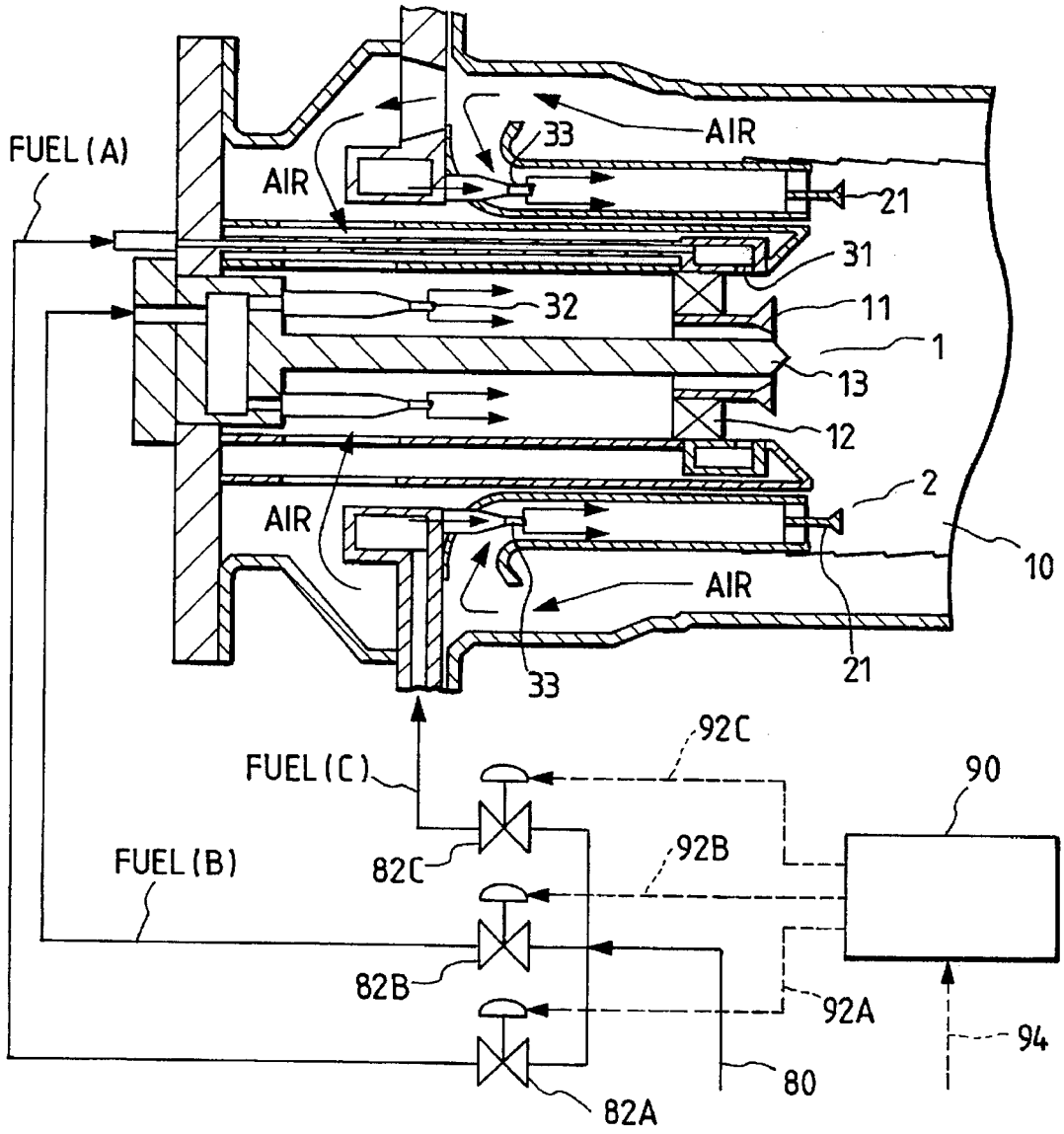
FIG. 2 is a sectional view of a gas turbine combustor of the present embodiment.
Figure 3:
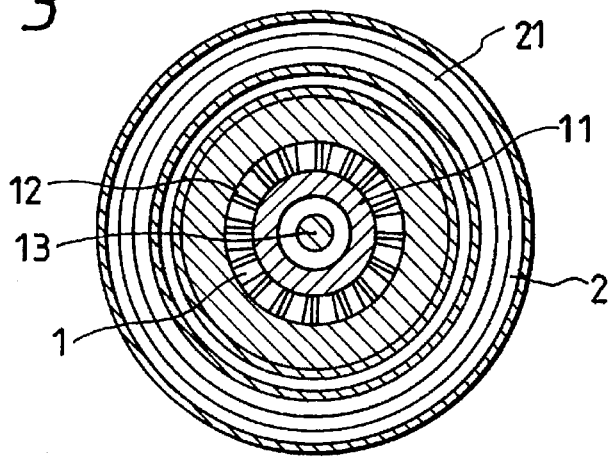
FIG. 3 is a sectional view of a burner construction in FIG. 2 viewed from a downstream side of the combustor.

FIG. 2 shows a sectional view of the gas turbine combustor and a fuel control system thereof. The combustor 100 of the present embodiment has a burner 1 arranged on a central axis and a coaxial cylindrical burner 2 arranged on an outer periphery of the burner 1. FIG. 3 is a sectional view of the constructions viewed from a downstream side. The burners 1, 2 each are supplied with air compressed by the air compressor 200 connected to the rotating shaft of the turbine. The air flows from a downstream side of a combustion chamber 10 to an upstream side as shown by arrows, and cools the combustor in the course of the flow. The burner 1 is supplied with fuel (A) for diffusion combustion from a fuel nozzle 31 and fuel (B) for premixed combustion from fuel nozzles 32, respectively. The burner 2 is supplied with fuel (C) for premixed combustion from fuel nozzles 33. The number and arrangement of the fuel nozzles 31, 32, 33 are not particularly limited. Further, in the present embodiment, although flame stabilization for the burner 2 is effected by a ring shaped flame stabilizer 21, this is not limited thereto, either.

Figure 4:
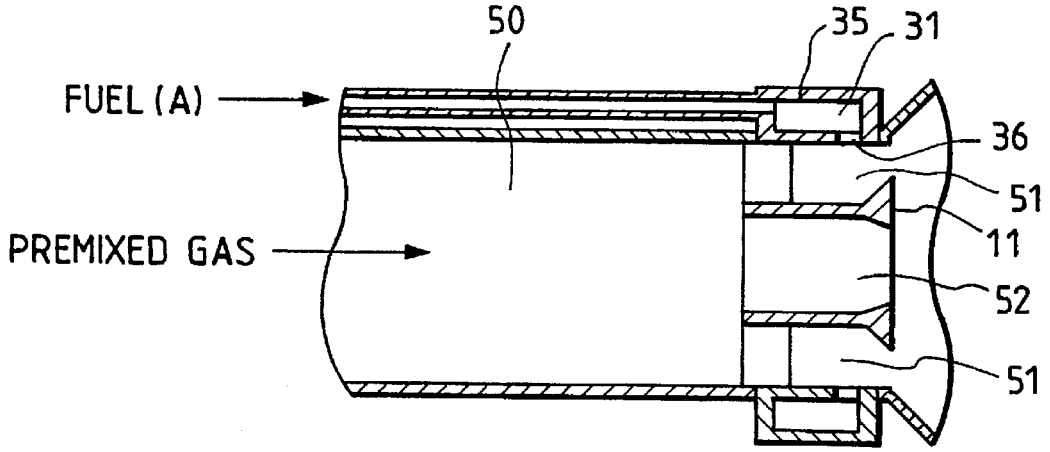
FIG. 4 is a partial sectional view of the burner for explanation of the present embodiment.
Figure 5:
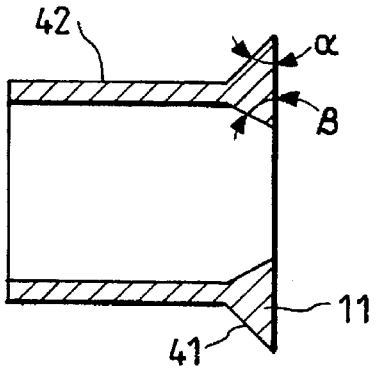
FIG. 5 is a partial sectional view of the burner for explanation of the present embodiment.

FIG. 4 is a enlarged view of a part of section of the burner 1 shown in FIG. 2. In the present embodiment, a flame stabilizer 11 which is ring-shaped in section as shown in FIG. 5 is used. The flame stabilizer 11 has a portion contacting with flame, that is, a flame stabilizing portion 41 formed generally triangular in section, and a cylindrical support portion 42 extending therefrom. Angles α and β of the flame stabilizing portion 41 are determined from a viewpoint of the strength including thermal stress, relation between the angles and flame stabilization performance, etc., and preferable to be in a range of 20°–80°. Further, the angles α and β may be different in value from each other. The supporting portion 42, in FIG. 4, is made in such length that a premixed gas flowing in the premixing chamber 50 is separated substantially into a flow passage 51 and a flow passage 52, whereby fuel (A) injected from the fuel nozzle 31 is supplied into only the flow passage 51 and does not leak in the fuel passage 52.

In FIG. 4, fuel (A) is injected into the flow passage 51 from fuel inlet holes 36 arranged in a fuel header 35. The fuel injection position is preferable to be 5–100 mm on an upstream side from an end face of the ring-shaped flame stabilizer 11 on a flame forming region side. With this construction, although a, part of fuel is mixed with air in a course of fuel injection, substantially stable diffusion combustion can be achieved.

Figure 6:
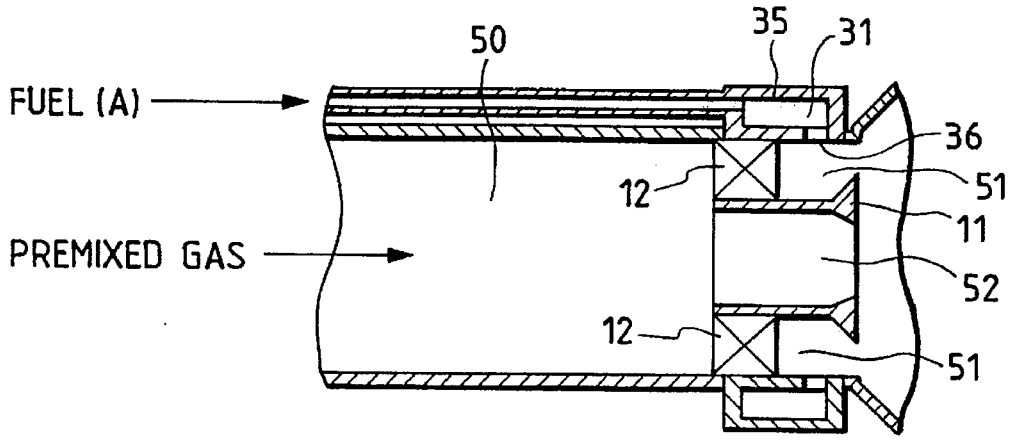
FIG. 6 is a partial sectional view of the burner for explanation of the present embodiment.

In the burner construction shown in FIG. 6, a swirler 12 is arranged in the flow passage 5i further to the burner construction of FIG. 4. By the swirler 12, mixing of fuel in diffusion flame and air is promoted, and emission of carbon monoxide and unburnt hydrocarbons can be suppressed. When the swirling angle is made large, the suppression effect becomes remarkable, on the other hand, combustion stability of diffusion flame is damaged. Therefore, the swirling angle is preferable to be 50° or less.

Figure 7:
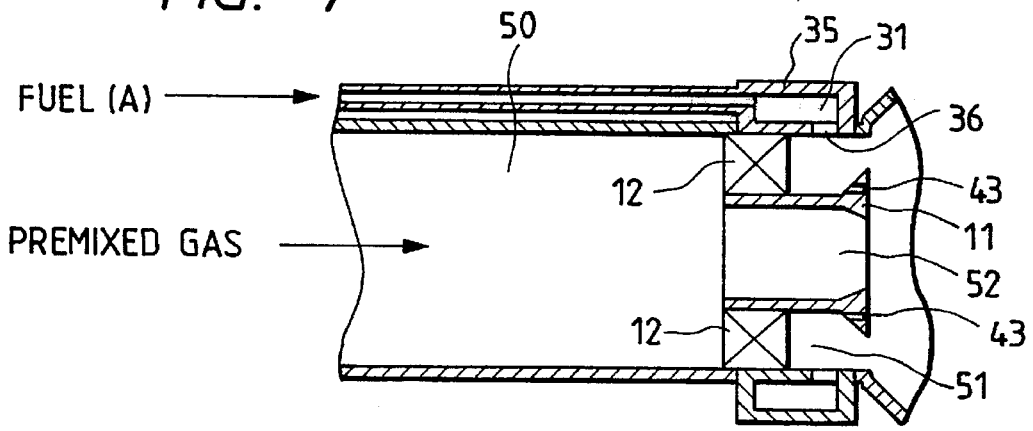
FIG. 7 is a partial sectional view of the burner for explanation of the present embodiment.

In the burner construction in FIG. 7, fluid jet holes 43 are formed on the-outer periphery side of the ring-shaped flame stabilizer 11 further to the burner construction of FIG. 6. Since fuel is supplied into the flow passage 51 on the outer side of the ring-shaped flame stabilizer 11, and the swirler 12 also is provided in the flow passage 51, strong turbulence occurs in this portion. However, fuel and air passed through the fluid jet holes 43 form stable flame in a flame stabilizing region in the wake of the ring-shaped flame stabilizer 11 since the strong disturbance thereof are rectified. The diameter of the fluid jet holes 43 is preferably 1–5 mm, and when the diameter is in the range, disturbance as mentioned above can be rectified without decreasing the strength of the ring-shaped flame stabilizer 11.

Figure 8:
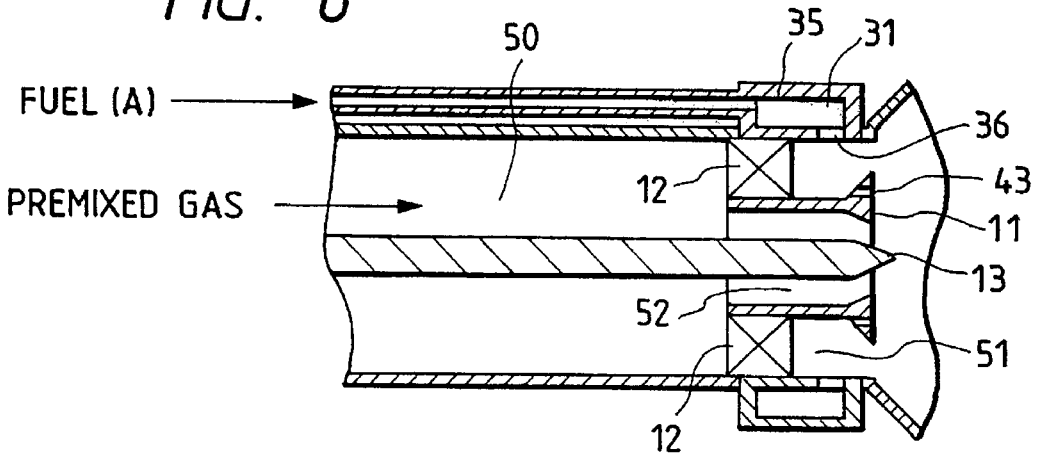
FIG. 8 is a partial sectional view of the burner for explanation of the present embodiment.

In the burner construction in FIG. 8, a solid rod 13 is arranged on the central axis of the ring-shaped flame stabilizer 11 further to the burner construction of FIG. 7. With the solid rod 13, since the flow passage area on the inner periphery side of the ring-shaped flame stabilizer 11 is reduced, the velocity of fluid passing there can be made into a velocity at which flame stabilizing performance is not detracted. Here, the tip of the solid rod 13 is sharpened to be small in diameter, the sharpened tip prevents flame from adhering on the tip.

Figure 9:
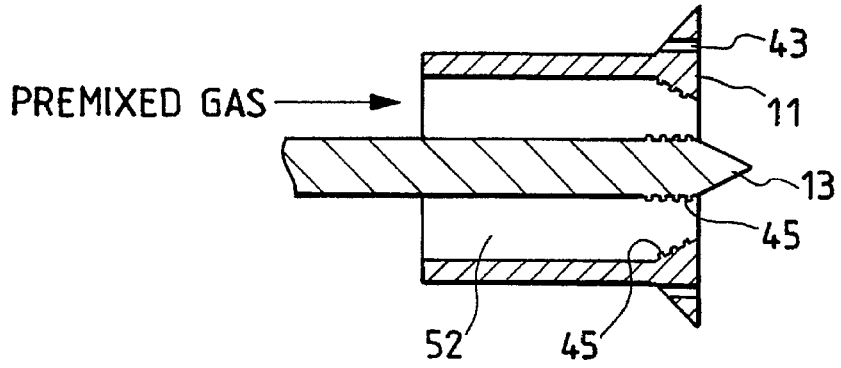
FIG. 9 is a partial sectional view of the burner for explanation of the present embodiment.
Figure 10:
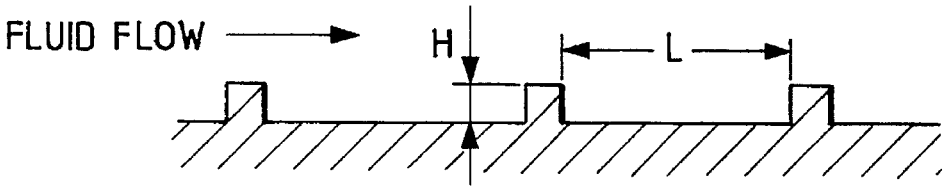
FIG. 10 is a partial sectional view of the burner for explanation of the present embodiment.

In the burner construction shown in FIG. 9, a plurality of projections or ribs 45 as turbulence promoters are provided on a wall face on the inner periphery side of the ring-shaped flame stabilizer 11 and a wall face of the solid rod 13 further to the burner construction of FIG. 8. The projections 45 are shaped as shown in FIG. 10, and the height H is 0.1 mm or more and 1 mm or less (0.1 mm=<H=<1 mm), and distance L therebetween is 4–20 times H. Since the projections 45 promote flow turbulence of fluid to promote heat transfer between the fluid flowing in the flow passage 52 and the ring-shaped flame stabilizer 11, the solid rod 13, it is preferable to arrange them only at portion in which temperature difference between them is large. The effect of turbulent flow promotion by the projections 45 does not largely differ by shape other than in FIG. 10, for example by trapezoid section or triangular section, the shape is not limited particularly as well as the arrangement of the projections.

Figure 11:
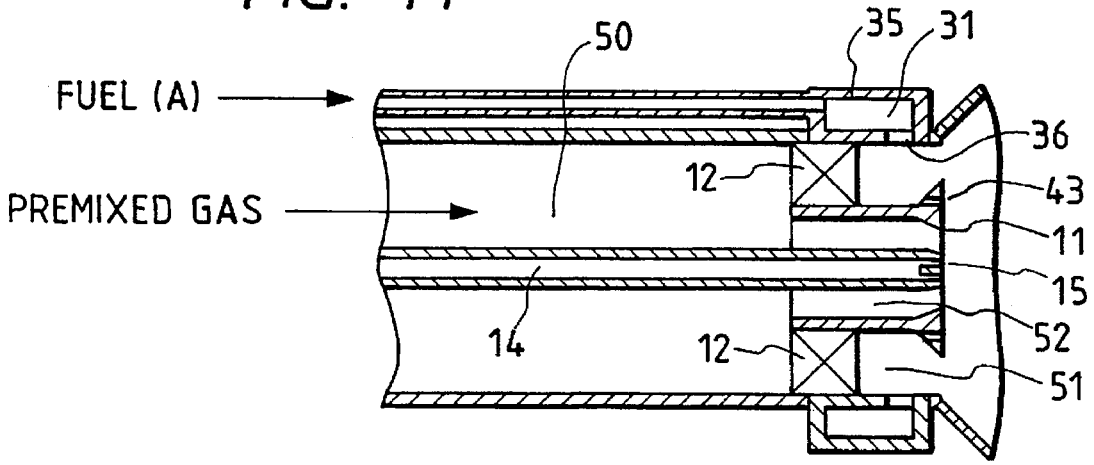
FIG. 11 is a partial sectional view of the burner for explanation of the present embodiment.

In the burner construction of FIG. 11, a hollow rod 14 is used instead of the solid rod 13 in FIG. 8 and the hollow rod 14 is made so that air flows therein and provided with air jet holes 15, further to the burner construction of FIG. 8. The air jet holes 15 are arranged so that air is jetted along the central axis of the ring-shaped flame stabilizer 11. Therefore, air flow jetted from the air jet holes 15 is formed on the central axis of the ring-shaped flame stabilizer 11, whereby flame formed from the inner periphery of the ring-shaped flames stabilizer 11 are prevented from interfering with each other in the wake.

An example of operation of the gas turbine combustor in which individual operations and effects as mentioned above are totalized is explained hereunder.

Referring to FIG. 2, fuel 80 is divided into fuel to be supplied into each burner on the basis of gas turbine load signal 94 by a fuel flow controller 90. That is, fuel (A) is supplied into the fuel nozzle 31 arranged on the outer periphery side of the ring-shaped flame stabilizer 11, with the opening of a fuel control valve 82A. Fuel flow rate is adjusted by control signal 92A from the fuel flow controller 90. In the same manner as the above, fuel (B) is supplied into the fuel nozzle 32, with opening of a fuel control valve 82B being adjusted by control signal 92B from the fuel flow controller 90. Fuel (C) is supplied into the fuel nozzle 33, with opening of a fuel control valve 82C being adjusted by a control signal 92C.

Next, fuel control operation is explained.

Figure 12:
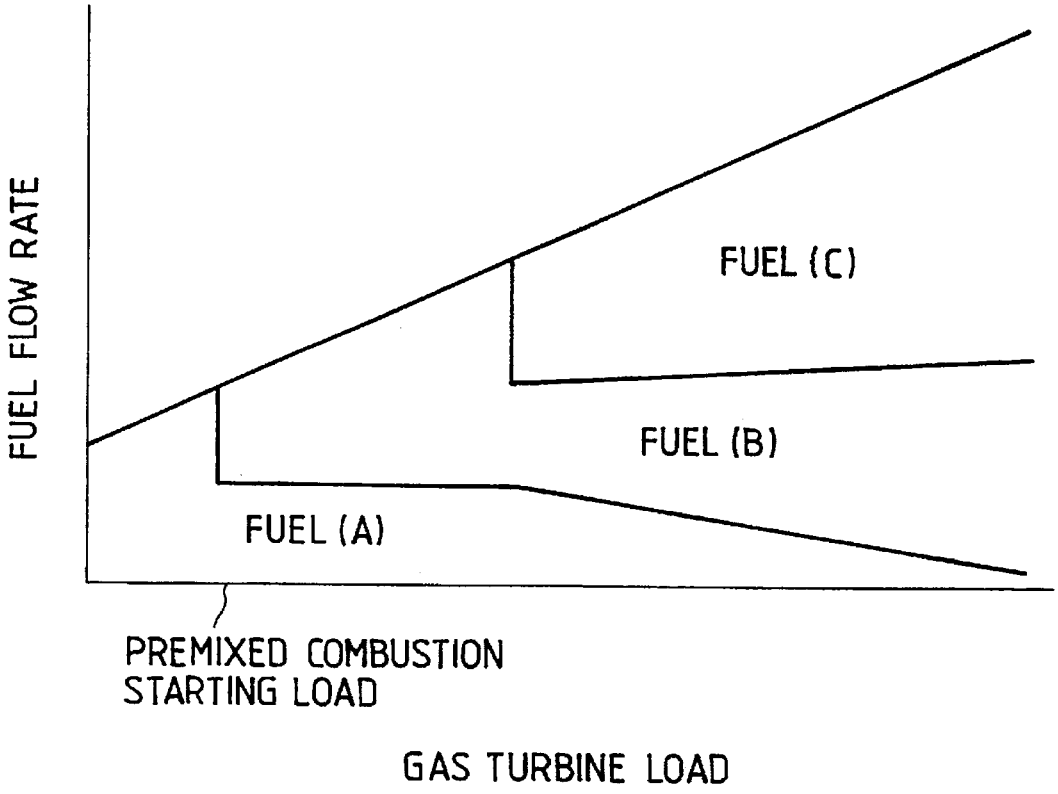
FIG. 12 is a graph showing relation between gas turbine load and fuel flow rate supplied to each burner.

As shown in FIG. 12, only fuel (A) is supplied at time of start up and low load to effect only diffusion combustion. When it reaches to a load at which premixed combustion is started, fuel for diffusion combustion is decreased and fuel (B) is supplied by the decrement of the fuel for diffusion combustion to effect premixed combustion. Here, premixed combustion flame of the fuel (B) is stabilized by the ring-shaped flame stabilizer 11. However, since diffusion combustion flame has been already formed on the outer periphery side of the ring-shaped flame stabilizer 11, circulation flow of high temperature has been formed in the wake of the ring-shaped flame stabilizer 11, whereby the premixed gas flows along the circulation flow to be easily fired.

Therefore, even under the conditions that fuel flow rate to be changed from fuel (A) to fuel (B) is small at time of start up of the premixed combustion, production of unburnt substances can be reduced. Since the smaller the fuel flow rate to be changed from fuel (A) to fuel (B) is, the more easily the unstable-combustion condition that may occur at time of fuel change can be avoided, the reliability of the gas turbine combustor can be raised.

Further, at time when load becomes high, the fuel (B) is decreased, fuel (C) of the same flow rate as decremented is injected to operate all the burners. At this time, since flame of high fuel air ratio is formed on the outer periphery side of the ring-shaped flame stabilizer 11, fuel (C) is easily fired. Therefore, fuel flow rate to be changed can be reduced to small one in the same manner as the fuel change from fuel (A) to fuel (B), whereby the reliability of the gas turbine can be raised.

Until it reaches a rated load after all the burners are operated, fuel flow rate is controlled so that fuel air ratios of premixed combustion of fuel (B) and fuel (C) are substantially the same as each other or fuel air ratio of fuel (B) is larger than that of the fuel (C), further, fuel (A) is reduced gradually to be 0 to 5% of all fuel flow rate at the rated load. This control can suppress NOx emission while securing the safety of combustion.

At time of start up and increase in speed of the gas turbine, the burner 1 is supplied with fuel (A) from the fuel nozzle 31. At the time of start up and increase in speed, both of air flow rate and fuel flow rate change greatly, therefore, fuel air ratio also changes. However, since stable diffusion flame is formed by the ring-shaped flame stabilizer 11, misfire does not occur. Fuel (B) is started to supply from the fuel nozzle 32 on the way of speed increase or at time of load operation. Fuel (B) is mixed with combustion air until it reaches the ring-shaped flame stabilizer 11. In general, when premixed gas becomes a certain fuel air ratio or less, for example, about 0.03 or less in case of methane fuel, it is difficult to continue stable combustion. However, in case of the present embodiment, diffusion flame is already formed on the ring-shaped flame stabilizer 11, so that stable premixed flame can be formed even if the fuel air ratio is about 0.02 or less.

In a stage in which load is further increased, fuel (C) is supplied from the fuel nozzle 33 so that flame is propagated to the burner 2 and the turbine reaches the rated load. When the flame propagation to the burner 2 is effected, since if fuel (A) is supplied fuel air ratio on the outer periphery side becomes large, the flame propagation is easy. In order to proceed smoothly flame propagation, it is preferable that fuel air ratio on the side of the burner 1 is 0.035 or more, preferably, 0.04 or more. However, in the present embodiment, the condition can be achieved locally easily by supplying fuel (A).

Fuel flow rate of fuel (A), fuel (B), fuel (C) in the above-mentioned operation is planned in detail taking into consideration load conditions, fuel air ratio for each burner, etc. Fuel (A) can be stopped to supply at the stage that the flame propagation is finished. As mentioned above, fuel (A) is for diffusion flame, so that stopping of the combustion at this portion can decrease NOx emission. On the other hand, when fuel (A) is supplied all over the operation range, stable diffusion flame always exists, so that misfire which may occur can be prevented.

According to the present embodiment, the combustion stability of burners can be achieved in a wide range of each of fuel flow rate and fuel air ratio, further it has an effect that flame propagation to adjacent burners is easy.

Figure 13:
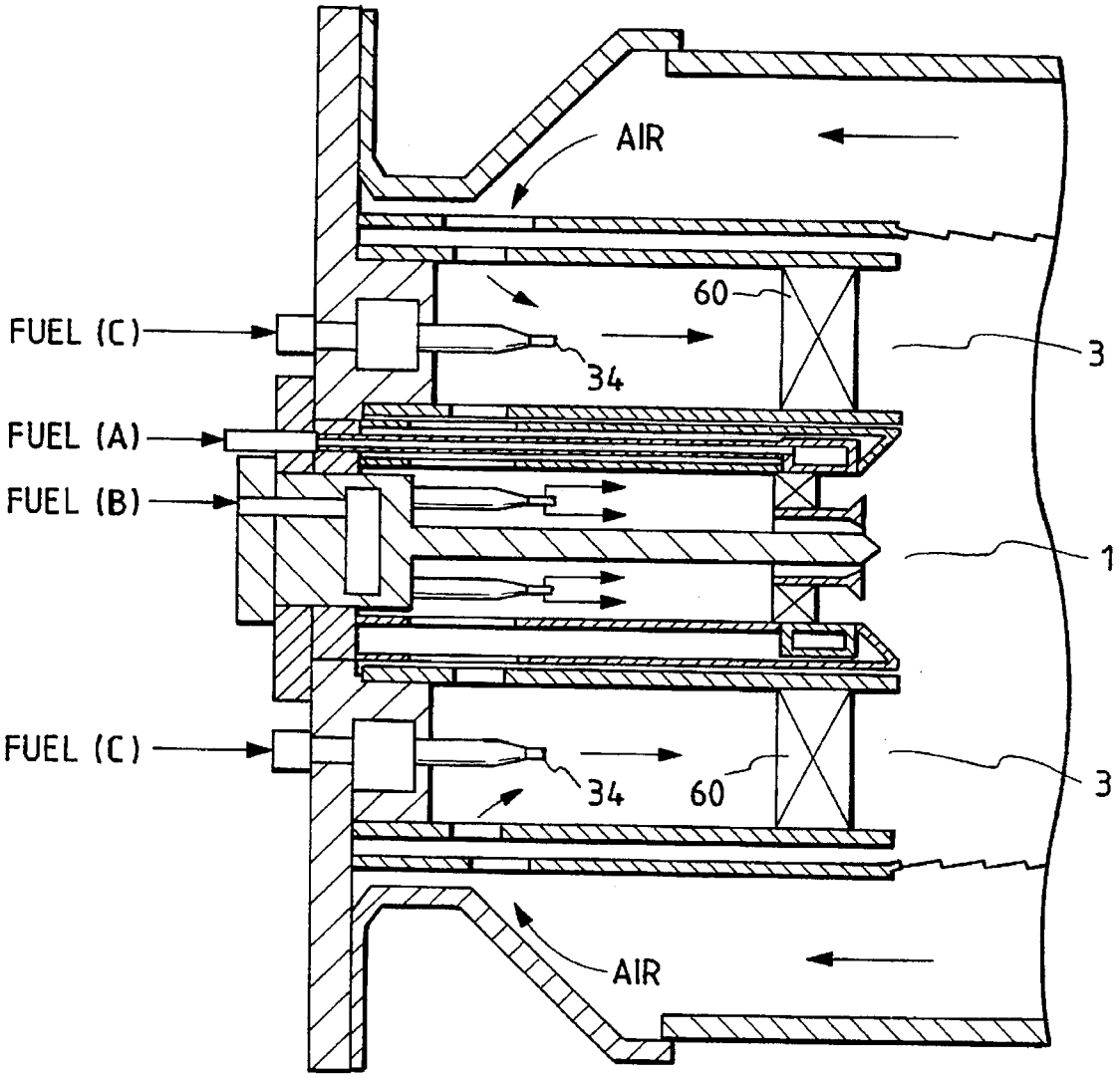
FIG. 13 is a sectional view of a gas turbine combustor of a second embodiment of the present invention.
Figure 14:
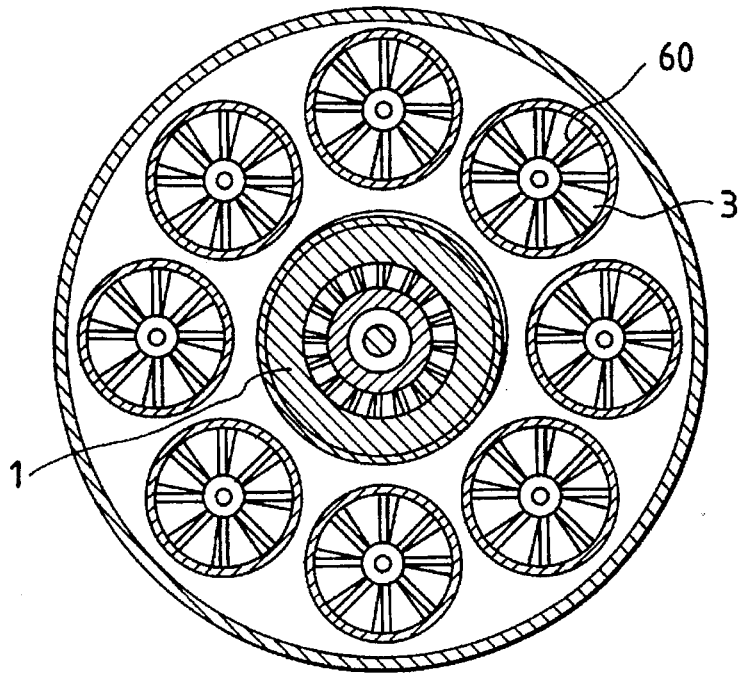
FIG. 14 is a view of a burner construction of FIG. 13 viewed from a downstream side of the combustor.

Another embodiment of the present invention is explained, referring to FIG. 13 and 14. FIG. 13 is a cross-sectional view of a gas turbine combustor of the present embodiment, and FIG. 14 is a view of a burner construction according to the embodiment of FIG. 13, viewed from a downstream side of the combustor. Difference from the first embodiment is in that eight (8) premixed burners 3 for premixing fuel jetted from a fuel nozzle 34 and air and burning the premixed gas are arranged around the burner 1. Here, the number of the premixed burners is not particularly limited, further, it is effective to provide each of the premixed burners 3 with a swirler 60. In the present embodiment, by the operation and effect of the burner 1 explained in the first embodiment, flame of the burner 1 can be easily propagated to the eight premixed burners 3.

The gas turbine combustor of this construction also can effect stable combustion.

Figure 15:
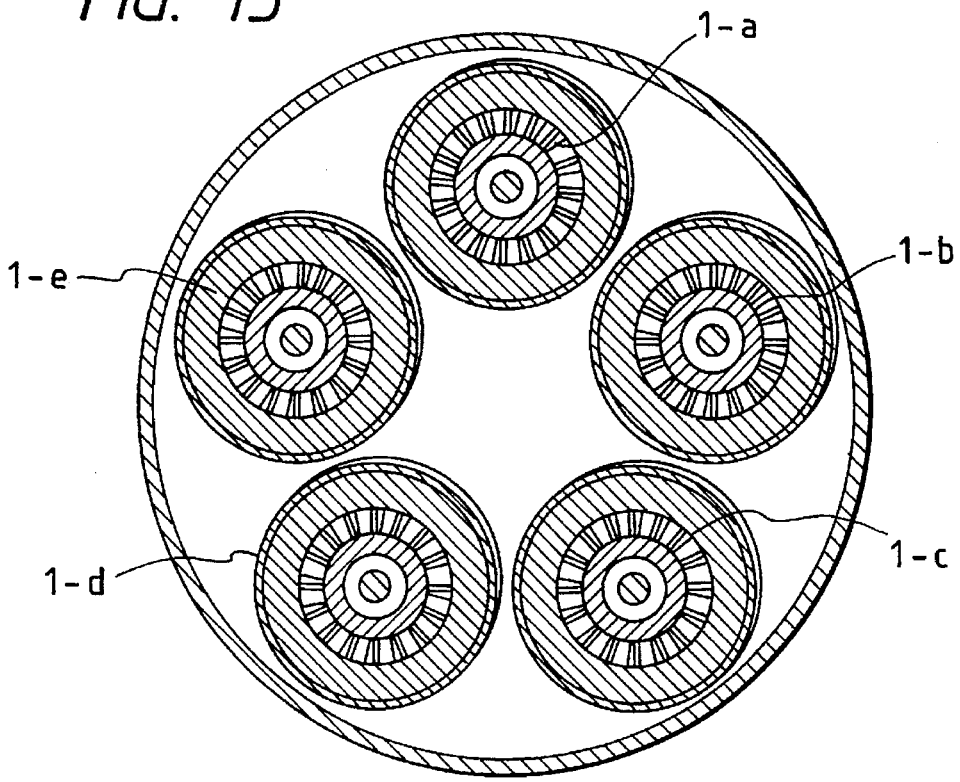
FIG. 15 is a view of burner construction of a gas turbine combustor of a third embodiment of the present invention, viewed from a downstream side.

Another embodiment of the present invention is explained, referring to FIG. 15. FIG. 15 is a view of a burner construction according to the present embodiment, viewed from a downstream side of a combustor. In the present embodiment, five burners 1-*a*, 1-*b*, 1-*c*, 1-*d* and 1-*e* each of which is the same as the burner 1 explained in the first embodiment are arranged. However, the number of the burners is not particularly limited. As explained in the first embodiment, the burner 1 can effect stable combustion in a wide range of fuel air ratio, and further, fuel air ratio on the outer side of the burner 1 can be made locally large. Therefore, in case of flame propagation from the burner 1-*a* to the burner 1-*b*, for instance, flame propagation can be effected at a low fuel air ratio as the entire burners by making fuel air ratio on the outer periphery side locally large.

According to the present embodiment, stability of the combustion can be raised at a wider range of fuel air ratio as the entire combustor.

According to the present invention, there is an effect that a flame stabilizing zone for stabilizing combustion flame of the burners can be stably secured in a wide range of fuel air ratio, and at the same time, flame propagation to adjacent burners and combustion stability also can be raised.

Further, by incorporating the gas turbine combustors according to the present invention, excellent gas turbine engines, gas turbine power plants can be provided.

What is claimed is:

1. A gas turbine combustor, comprising: a combustion chamber, a premixing chamber for premixing fuel introduced into the combustion chamber and combustion air to form premixed gas, and a flame stabilizer, positioned around an outlet end of the premixing chamber, having a shape spreading toward a downstream side, deflecting the premixed gas from straight flow to divergent flow, and producing recirculation zone in course of the deflection, wherein said flame stabilizer has a ring-like shape, and fuel inlet holes are provided in a wall of said premixing chamber in the vicinity of an outlet thereof for introducing fuel into said premixing chamber.

2. A gas turbine combustor according to claim 1, wherein said flame stabilizer has a cylindrical shape and consists of a uniform thickness portion on an upstream side thereof and a thickness increase portion on a downstream side, the thickness of which spreads divergently toward a downstream side, and a swirler for swirling fluid flowing in said premixing chamber is provided on the outer periphery side of the cylindrical portion of said flame stabilizer on the upstream side of said diffusion combustion fuel inlet holes.

3. A gas turbine combustor according to claim 2, wherein fuel jet holes each are provided on the thickness increasing portion of said flame stabilizer for allowing a part of fluid to pass therethrough to a downstream side of said flame stabilizer.

4. A gas turbine combustor according to claim 1, wherein a rod-like member extending from an upstream side end of said premixing chamber so as to pass through a hollow portion of said flame stabilizer is provided around the center of said premixing chamber, a downstream side end of said rod-like member being tapered so as to have a diameter toward a downstream side that is smaller than that at the upstream side end.

5. A gas turbine combustor according to claim 4, wherein a plurality of flow disturbing ribs are provided on said rod-like member in the vicinity of a top end thereof on a portion opposite a portion of said flame stabilizer which spreads toward a downstream side.

6. A gas turbine combustor according to claim 4, wherein means for supplying air to an inner periphery side of said flame stabilizer through an interior thereof is provided.

7. A gas turbine combustor according to claim 1, wherein a plurality of flow disturbing ribs are provided on an inner peripheral side wall of a portion of said flame stabilizer which spreads divergently toward a downstream side.

8. A gas turbine combustor according to claim 1, wherein a plurality of premixing chambers or premixed combustion burners each having diffusion combustion fuel inlet holes are arranged substantially equidistantly in said combustion chamber.

9. A gas turbine comprising a plurality of gas turbine combustors each as defined in claim 8, a turbine driven by combustion gas produced in each of said gas turbine combustors, and an air compressor connected to a rotating shaft of said turbine.

10. A gas turbine electric power generation equipment comprising a gas turbine as defined in claim 9 and an electric generator driven by said gas turbine for generating electric power.

11. A gas turbine combustor according to claim 1, wherein said premixing chamber having said fuel inlet holes is arranged in substantially the center of said combustion chamber, said fuel inlet holes being for diffusion combustion, and an annular fluid swirling type burner only for premixed combustion is arranged around said premixed chamber.

12. A gas turbine combustor according to claim 1, wherein said premixing chamber having said diffusion combustion fuel inlet holes is arranged in substantially the center of said combustion chamber, and a plurality of fluid swirling type burners only for premixed combustion are arranged substantially equidistantly around said premixed chamber.

13. A gas turbine combustor, comprising: a premixed combustion burner for forming premixed flame in a combustion chamber and a diffusion combustion burner for forming diffusion flame, and constructed so that fuel flow rate to be supplied to said premixed combustion burner and fuel flow rate to be supplied to said diffusion combustion burner are controlled according to gas turbine load wherein, said diffusion combustion burner is constructed so that diffusion combustion fuel inlet means for introducing fuel from outside into a burner interior thereof is provided in the vicinity of an outlet of said premixed combustion burner and air is used commonly for diffusion combustion and premixed combustion, and a ring-shaped flame stabilizer is provided at a outlet end of said premixed combustion burner on the downstream side of said diffusion combustion fuel inlet means, said flame stabilizer having a ring-shape the section of which spreads divergently toward a downstream side.

14. A gas turbine combustor according to claim 13, wherein said flame stabilizer has a cylindrical shape and consists of a uniform thickness portion on an upstream side thereof and a thickness increase portion on a downstream side, the thickness of which spreads divergently toward a downstream side, and a swirler for swirling fluid flowing in said premixed burner is provided on the outer periphery side of the cylindrical portion of said flame stabilizer on the upstream side of said diffusion combustion fuel inlet means.

15. A gas turbine combustor, comprising:

a combustion chamber;

at least one premixing chamber for premixing fuel introduced into said combustion chamber and combustion air to form premixed gas;

at least one premixed combustion fuel nozzle for introducing fuel into said premixing chamber;

combustion air supply means for causing air compressed by a compressor connected to a turbine to flow in said combustion chamber from a downstream side to an upstream side thereof to cool said combustion chamber and then supplying the air into said premixing chamber;

fuel inlet holes provided in a wall in the vicinity of an outlet of said premixing chamber;

diffusion combustion fuel supply means for supplying diffusion combustion fuel from outside of said combustor into said fuel inlet holes;

a flame stabilizer, disposed around the outlet of said premixing chamber on the downstream side of said fuel inlet holes, and having a ring shape the section of which spreads divergently toward a downstream side; and fuel flow rate control means for controlling flow rates of fuel supplied into said premixed combustion fuel nozzle and said diffusion combustion fuel supply means according to gas turbine load.

* * * * *